US006703781B2

(12) United States Patent
Zovko

(10) Patent No.: US 6,703,781 B2
(45) Date of Patent: Mar. 9, 2004

(54) EL LAMP WITH LIGHT SCATTERING PARTICLES IN CASCADING LAYER

(75) Inventor: Charles I. Zovko, Chandler, AZ (US)

(73) Assignee: Durel Corporation, Chandler, AZ (US)

( * ) Notice: Subject to any disclaimer, the term of this patent is extended or adjusted under 35 U.S.C. 154(b) by 71 days.

(21) Appl. No.: 10/154,062

(22) Filed: May 21, 2002

(65) Prior Publication Data

US 2003/0218420 A1 Nov. 27, 2003

(51) Int. Cl.[7] ..... H01J 29/18
(52) U.S. Cl. ..... 313/506; 313/503; 313/461
(58) Field of Search ..... 315/169.1, 169.3; 313/501, 506, 507, 509, 512, 503

(56) References Cited

U.S. PATENT DOCUMENTS

| | | | | |
|---|---|---|---|---|
| 3,050,655 A | | 8/1962 | Goldberg et al. | 313/108 |
| 3,052,810 A | | 9/1962 | Mash | 313/108 |
| 3,248,588 A | | 4/1966 | Blazek et al. | 313/108 |
| 5,053,679 A | * | 10/1991 | Thioulouse | 315/169.3 |
| 5,517,080 A | * | 5/1996 | Budzilek et al. | 313/509 |
| 5,804,919 A | * | 9/1998 | Jacobsen et al. | 313/506 |
| 6,023,371 A | | 2/2000 | Onitsuka et al. | 359/620 |
| 6,225,741 B1 | | 5/2001 | Nakamura et al. | 313/506 |
| 6,441,551 B1 | * | 8/2002 | Abe et al. | 313/503 |
| 6,617,784 B1 | * | 9/2003 | Abe et al. | 313/506 |

* cited by examiner

*Primary Examiner*—Don Wong
*Assistant Examiner*—Jimmy T. Vu
(74) *Attorney, Agent, or Firm*—Paul F. Wille

(57) ABSTRACT

Light scattering particles are added to the ink used for printing the cascading layer. The particles and cascading material are then printed in the same layer. Light entering the cascading layer is scattered, re-entering the cascading material thereby increasing the effectiveness of the cascading material and enabling one to use less material. Because less cascading material is used, the cost of the EL lamp is reduced and cascading efficiency is increased. The light scattering particles and the cascading material are in an overprint or are in the phosphor layer.

12 Claims, 2 Drawing Sheets

EL LAMP WITH LIGHT SCATTERING PARTICLES IN CASCADING LAYER

BACKGROUND OF THE INVENTION

This invention relates to electroluminescent (EL) lamps and, in particular, to an EL lamp having an overprint layer including light scattering particles mixed in with the cascading dyes or phosphors.

An EL lamp is essentially a capacitor having a dielectric layer between two conductive electrodes, one of which is transparent. The dielectric layer includes a phosphor powder or there is a separate layer of phosphor powder adjacent the dielectric layer. The phosphor powder emits light in the presence of a strong electric field, using very little current. An EL lamp requires high voltage, alternating current but consumes very little power.

EL phosphor particles are zinc sulfide-based materials, typically including one or more compounds such as copper sulfide ($Cu_2S$), zinc selenide (ZnSe), and cadmium sulfide (CdS) in solid solution within the zinc sulfide crystal structure or as second phases or domains within the particle structure. EL phosphors typically contain moderate amounts of other materials such as dopants, e.g., bromine, chlorine, manganese, silver, etc., as color centers, as activators, or to modify defects in the particle lattice to modify properties of the phosphor as desired. A copper-activated zinc sulfide phosphor produces blue and green light under an applied electric field and a copper/manganese-activated zinc sulfide produces orange light under an applied electric field. Together, the phosphors produce white light under an applied electric field.

Because EL lamps provide uniform luminance and consume very little power, there is a great demand for EL lamps in displays. There is also a great demand for a variety of colors, which is difficult to meet from a limited number of phosphors. The color of a phosphor is a quantum mechanical phenomenon that, by definition, does not provide a continuous spectrum of colors. Thus, EL lamps produce light having a limited spectrum with pronounced peaks. Phosphors emitting different colors can be mixed and a particular spectrum or color is obtained by enclosing a designated point on a CIE [Commission Internationale de l'Eclairage] chromaticity diagram. The available phosphors must define an area that encloses the designated point or area.

It has long been known in the art to "cascade" phosphors, i.e. to use the light emitted by one phosphor to stimulate another phosphor or other material to emit light at a longer wavelength; e.g. see U.S. Pat. No. 3,050,655 (Goldberg et al.). It has also long been known to use dyes as the cascading material; e.g. see U.S. Pat. No. 3,052,810 (Mash). It is also known to doubly cascade phosphors. U.S. Pat. No. 6,023,371 discloses an EL lamp that emits blue light coated with a layer containing fluorescent dye and fluorescent pigment. In one example, the pigment absorbs blue light and emits green light, while the dye absorbs green light and emits red light.

Mixing different phosphors, cascading phosphors, and filtering are three of several techniques known in the art for obtaining colors other than the strongest emission band of a particular phosphor. Cascading phosphors and filtering absorb light and therein lies a problem. The net amount of light emitted by an EL lamp depends upon how much light is generated initially, how much is absorbed by cascading materials, and how efficiently the cascading materials convert light to longer wavelengths. Often, a great deal of dye is necessary to produce the desired color.

The amount of dye in an ink affects several aspects of making an EL lamp. Often, the amount dye necessary to produce a desired color absorbs too much light and the lamp is too dim for commercial success. Also, some dyes are relatively expensive, making the cost of some lamps prohibitive. Finally, the amount of dye affects print quality. Inks containing less dye can be printed through a finer mesh than the same ink more heavily loaded with dye. Being able to use less dye or less phosphor, or printing with fewer passes to deposit an effective amount of material, would also benefit the construction of existing types of lamps.

U.S. Pat. No. 3,248,588 (Blazek et al.) discloses using a cascading dye as an "underprint," i.e. between the phosphor layer and the rear electrode. The patent further discloses adding barium titanate to the dye layer to act as a reflective background and increase brightness. Such a layer as an overprint would be substantially opaque. U.S. Pat. No. 6,225,741 (Nakamura et al.) discloses using barium titanate ($BaTiO_3$) or titania ($TiO_2$) in an organic polymer layer as a separate reflecting layer between the phosphor layer and the rear electrode.

In view of the foregoing, it is therefore an object of the invention to provide an EL lamp that uses cascading phosphor or dye more efficiently than in the prior art.

Another object of the invention is to provide an EL lamp in more colors than were previously available.

A further object of the invention is to provide an EL lamp using cascading materials that is less expensive than lamps using the same materials and constructed in accordance with the prior art.

Another object of the invention is to increase the brightness of EL lamps using cascading materials.

A further object of the invention is to improve the print quality of inks containing cascading material.

Another object of the invention is to be able to print an effective amount of material in fewer passes than in the prior art.

SUMMARY OF THE INVENTION

The foregoing objects are achieved in this invention wherein light scattering particles are added to the ink containing the cascading material. The particles and cascading material are then printed in the same layer. Light entering the cascading layer is scattered, re-entering the cascading material thereby increasing the effectiveness of the cascading material and enabling one to use less material. Because less cascading material is used, the cost of the EL lamp is reduced and cascading efficiency is increased. The preferred light scattering particle is titania.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
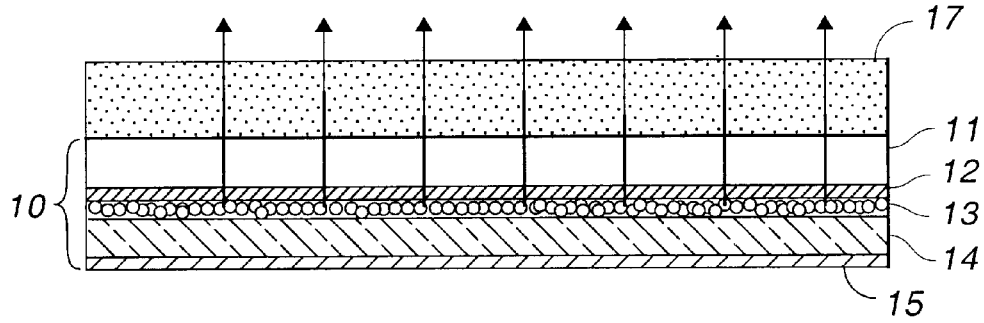
FIG. 1 (Prior Art)
FIG. 1 is a cross-section of an EL lamp constructed in accordance with the prior art.

In FIG. 1, EL lamp 10 includes transparent substrate 11 of polyester or polycarbonate material. Transparent electrode 12 overlies substrate 11 and includes indium tin oxide or indium oxide. Phosphor layer 13 overlies electrode 12 and dielectric layer 14 overlies the phosphor layer. Overlying dielectric layer 14 is conductive layer 15 containing conductive particles such as silver or carbon in a resin binder. Conductive layer 15 is the rear electrode. Layer 17 is overprinted on lamp 10 and contains a cascading dye that converts some of the light emitted by phosphor layer 13 into light of a different color or spectrum. The layers are not drawn to scale in any figure.

During operation, an alternating current is applied to electrodes 12 and 15, causing a minute current to flow between the electrodes, through the lamp, causing the phosphor in layer 13 to emit light. The light passes through cascading layer 17, where some of the blue light is converted into light having a longer wavelength by the dye. Not all the light is converted to a longer wavelength and the lamp has a color that is the combination of the spectra of the phosphor and the dye.

Figure 2:
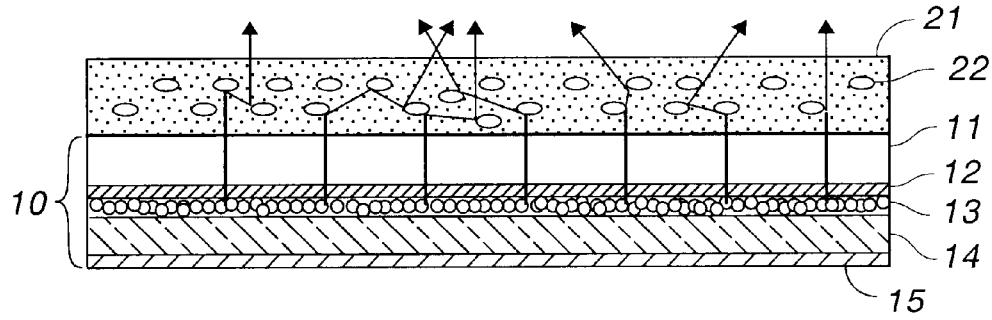
FIG. 2 is a cross-section of an light source constructed in accordance with a preferred embodiment of the invention.

FIG. 2 is a cross-section of an EL lamp including an overprint constructed in accordance with a preferred embodiment of the invention, wherein light scattering particles are added to the cascading layer. Overprint layer 21 includes a cascading dye or phosphor, represented by the stippling, and light scattering particles, represented by small ellipses such as ellipse 22. Adding light scattering material is believed to increase the length of the path that the light takes through the cascading material, thereby increasing the effectiveness of the cascading material.

Titania is a preferred material for the light scattering particles because it is readily available and is inexpensive because it is widely used for other purposes, such as in white paint. Titania typically has a particle size of 0.25$\mu$ and other particle sizes are available. Barium titanate or other light scattering materials could be used instead of or with titania.

As an example of the invention, an ink used for overprinting was prepared as follows.

| | |
|---|---|
| SPL 8826 Clear Vinyl Ink Base (Nazdar) | 265.0 gr. |
| Pyrromethene 567 Solution (1% in DMAC) | 20.0 gr. |
| Sulforhodamine 640 Solution (0.25% in DMAC) | 24.0 gr. |
| Care 22 Flow Agent | 1.5 gr. |

Obviously very little dye is being used (0.26 grams total).

As known in the art, there are a host of cascading materials that can be used and the invention is not restricted to the ones in the example. The particular dyes used happened to be on hand. Pyrromethene 567 absorbs energy in the blue-green area of the spectrum and emits light in the green area of the spectrum. In particular, Pyrromethene 567 has an absorption peak at 517 nm and emits light with a peak at 546 nm. Sulforhodamine 640 absorbs energy in the yellow region of the spectrum, 576 nm maximum, and emits light in the red region of the spectrum, with a maximum at 602 nm.

Figure 3:
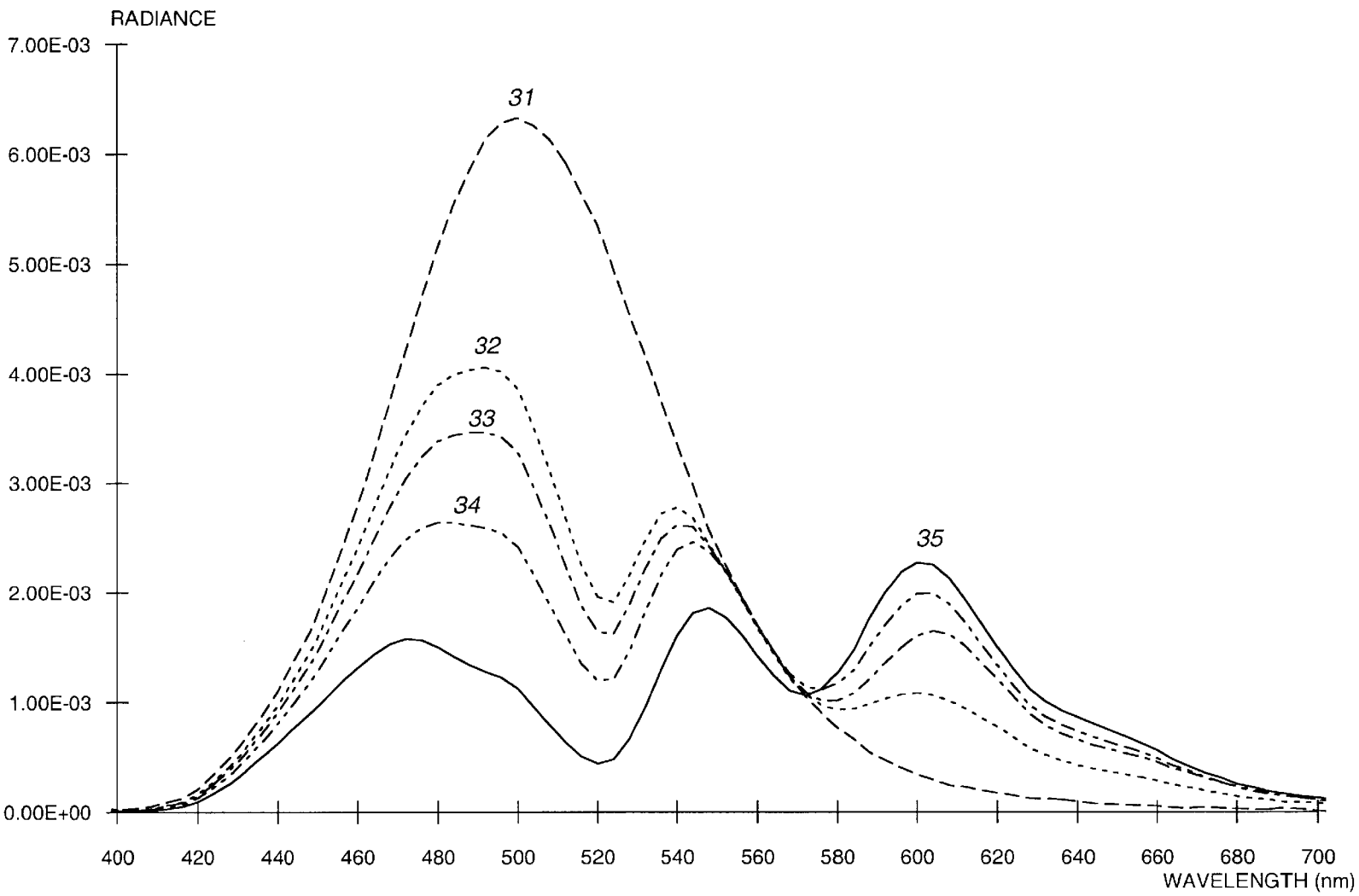
FIG. 3 is a chart of data from lamps constructed in accordance with the invention with various concentrations of light scattering particles.

Titania was added in the form of white ink, specifically Nazdar 8825 White Ink., one of many commercially available sources of titania that can be used in the invention. The concentration of titania in the 8825 ink is not known. Lamps were overprinted with 0%, 1%, 3%, and 12.3% by weight white ink added to the cascading ink (ink base plus dye and flow enhancer). The lamps were overprinted in a single pass. FIG. 3 is a chart of data from lamps constructed in accordance with the invention with various concentrations of light scattering particles. Included in the chart is curve 31, which represents the output from an otherwise identical lamp with no cascading layer. Curve 32 corresponds to 0% (i.e. dye only), curve 33 corresponds to 1% added white ink, curve 34 corresponds to 3% added white ink, and curve 35 corresponds to 12.3% added white ink.

As shown by FIG. 3, there is a pronounced reddening of the lamp from adding light scattering particles. Adding light scattering particles to the cascading ink provides a highly desirable alternative to adding dye, which, as noted above, causes printing problems and is much more expensive. The maximum amount of light scattering particles that can be added is not a factor because one is trying to obtain a particular color spectrum, which is readily determined empirically and depends upon the spectrum of the EL lamp, the cascading material used, and the light scattering material used.

Figure 4:
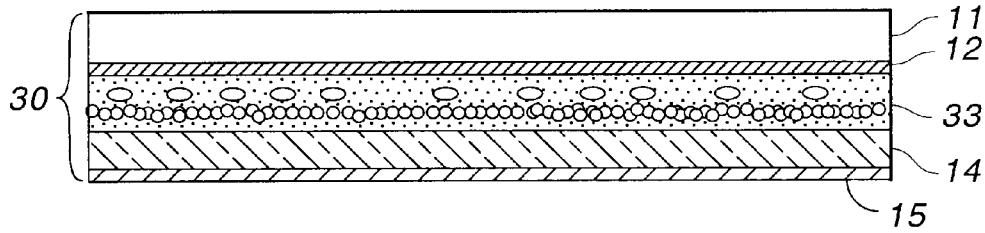
FIG. 4 is a cross-section of an EL lamp constructed in accordance with an alternative embodiment of the invention.

FIG. 4 illustrates an alternative embodiment of the invention in which light scattering particles and cascading materials are combined with the electroluminescent phosphor layer. EL lamp 30 is constructed as in the prior art except that phosphor layer 33 contains cascading dye or fluorescent material or cascading phosphor and also contains light scattering particles. While illustrated as thicker than phosphor layer 13 (FIG. 2), phosphor layer 33 is approximately the same thickness because the light scattering particles are so small and so little cascading material is used. Thus, newly designed lamps can benefit from the invention. Older designs can be made as before, with the overprint to achieve the desired color.

The invention thus provides an EL lamp that uses cascading pigment or dye more efficiently and provides more colors than available in the prior art. An EL lamp overprinted in accordance with the invention is less expensive than lamps using the same cascading materials without light scattering particles. The resulting lamps can be brighter because less cascading material is used. Print quality is improved by using less cascading material and fewer passes are necessary for printing.

Having thus described the invention, it will be apparent to those of skill in the art that many modifications can be made with the scope of the invention. For example, cascading fluorescent materials can be used instead of dyes. Halftone printing can be used to provide two dyes in a single layer. Mixing two dyes in a single layer produces three peaks: blue, green, and red. Phosphor particles can be cascaded to provide peaks of blue, green and red. Although described in the context of screen printing, the layer of cascading material and light scattering particles can be produced by any other means known in the art; e.g. roll coating or spinning.

What is claimed as the invention is:

1. An electroluminescent lamp comprising:

a rear electrode;

a dielectric layer overlying said rear electrode;

a phosphor layer overlying said dielectric layer;

a transparent electrode overlying said phosphor layer;

a transparent substrate overlying said transparent electrode; and an overprint layer overlying said transparent substrate, said overprint layer including cascading material and light scattering particles.

2. The EL lamp as set forth in claim 1 wherein said overprint layer is printed from an ink containing one to twelve percent by weight white ink.

3. The EL lamp as set forth in claim 2, wherein said overprint layer is printed from an ink containing less than 0.5 gram cascading material.

4. The electroluminescent lamp as set forth in claim 1 wherein said light scattering particles comprise titania.

5. The electroluminescent lamp as set forth in claim 4 wherein said light scattering particles have an average diameter of 0.25 $\mu$.

6. The electroluminescent lamp as set forth in claim 1 wherein said light scattering particles comprise barium titanate.

7. The electroluminescent lamp as set forth in claim 1 wherein said light scattering particles comprise a mixture titania and barium titanate.

8. An electroluminescent lamp comprising:

a rear electrode;

a dielectric layer overlying said rear electrode;

a phosphor layer overlying said dielectric layer, said phosphor layer including cascading material and light scattering particles;

a transparent electrode overlying said phosphor layer; and a transparent substrate overlying said transparent electrode.

9. The electroluminescent lamp as set forth in claim 8 wherein said light scattering particles comprise titania.

10. The electroluminescent lamp as set forth in claim 8 wherein said cascading material includes at least one fluorescent dye and at least one fluorescent pigment.

11. The electroluminescent lamp as set forth in claim 8 wherein said light scattering particles comprise barium titanate.

12. The electroluminescent lamp as set forth in claim 8 wherein said light scattering particles comprise a mixture titania and barium titanate.

* * * * *